US008740338B2

(12) United States Patent
Seo et al.

(10) Patent No.: US 8,740,338 B2
(45) Date of Patent: Jun. 3, 2014

(54) INK-JET PRINT APPARATUS AND METHOD

(75) Inventors: Hwang Un Seo, Busan (KR); Hong Myeong Jeon, Gyeongbuk (KR); Man In Baek, Gyeonggi-do (KR)

(73) Assignees: LG Display Co., Ltd., Seoul (KR); LG Electronics Inc., Seoul (KR)

( * ) Notice: Subject to any disclaimer, the term of this patent is extended or adjusted under 35 U.S.C. 154(b) by 261 days.

(21) Appl. No.: 12/546,749

(22) Filed: Aug. 25, 2009

(65) Prior Publication Data

US 2010/0156968 A1 Jun. 24, 2010

(30) Foreign Application Priority Data

Dec. 22, 2008 (KR) ..... 10-2008-0130931

(51) Int. Cl.
*B41J 29/393* (2006.01)

(52) U.S. Cl.
USPC ..... 347/19; 347/3; 347/10

(58) Field of Classification Search
USPC ..... 347/2, 3, 5, 9, 10, 12, 19; 356/432; 382/112
See application file for complete search history.

(56) References Cited

U.S. PATENT DOCUMENTS

| | | | | |
|---|---|---|---|---|
| 6,221,544 | B1 | 4/2001 | Hayashi et al. | |
| 6,258,405 | B1 | 7/2001 | Yamaguchi et al. | |
| 6,273,542 | B1 * | 8/2001 | Couwenhoven et al. | 347/19 |
| 6,290,352 | B1 | 9/2001 | Marumoto et al. | |
| 7,445,304 | B2 * | 11/2008 | Sakaida et al. | 347/10 |
| 7,627,141 | B2 * | 12/2009 | Noffke et al. | 382/112 |
| 7,852,525 | B2 | 12/2010 | Nogami et al. | |
| 2004/0051817 | A1 | 3/2004 | Takahashi et al. | |
| 2005/0275908 | A1 | 12/2005 | Nogami et al. | |
| 2006/0071974 | A1 | 4/2006 | Kawase | |
| 2006/0165878 | A1 | 7/2006 | Kim et al. | |
| 2007/0109606 | A1 | 5/2007 | Nagae | |
| 2007/0285454 | A1 | 12/2007 | Shang et al. | |
| 2009/0185186 | A1 * | 7/2009 | Shang et al. | 356/432 |

FOREIGN PATENT DOCUMENTS

| | | | |
|---|---|---|---|
| JP | 10315510 | A | 12/1998 |
| JP | 2000147243 | A | 5/2000 |
| JP | 2000193814 | A | 7/2000 |
| JP | 2000266920 | A | 9/2000 |
| JP | 2001-147317 | A | 5/2001 |

(Continued)

OTHER PUBLICATIONS

Examination Statement issue Nov. 28, 2011 in counterpart Taiwanese patent application.

(Continued)

*Primary Examiner* — Lam S Nguyen
(74) *Attorney, Agent, or Firm* — Morgan, Lewis & Bockius LLP

(57) ABSTRACT

An ink-jet print apparatus adapted to prevent stain defects is disclosed.

The ink-jet print apparatus includes: first to third head portions configured to form red, green, and blue color filters on a substrate; a plurality of nozzles provided in each of the first to third head portions; a camera, above the substrate, configured to photograph a transmittance of each of sub-pixels in which the red, green, and blue are formed; a light emission unit, under the substrate opposite to the camera, configured to emit light on the sub-pixel; and an injection quantity control unit configured to compare the transmittance of each sub-pixel photographed by the camera with a previously prepared reference transmittance and to compensate the injection quantity of the nozzle.

5 Claims, 5 Drawing Sheets

(56) References Cited

FOREIGN PATENT DOCUMENTS

| | | | |
|---|---|---|---|
| JP | 2004055520 | A | 2/2004 |
| JP | 2004-117739 | A | 4/2004 |
| JP | 2007-136310 | A | 6/2007 |
| KR | 10-2006-0084975 | A | 7/2006 |
| TW | 1267294 | | 11/2006 |
| TW | I267294 | B | 11/2006 |
| TW | 200806486 | | 6/2007 |
| TW | 1289213 | | 11/2007 |
| TW | I289213 | B | 11/2007 |
| TW | 200806486 | A | 2/2008 |

OTHER PUBLICATIONS

Office Action from the Taiwan Advance Patent & Trademark Office dated May 29, 2012, in a counterpart Taiwanese application.

KIPO—Office Action for Korean Patent Application No. 10-2008-0130931—Issued on Apr. 2, 2013.

Office Action dated Dec. 10, 2013, issued by the Japanese Patent Office in Japanese Patent Application No. 2009-145235.

Office Action dated Mar. 27, 2012 from the Japanese Patent Office in a counterpart Japanese application.

* cited by examiner

INK-JET PRINT APPARATUS AND METHOD

CROSS-REFERENCE TO RELATED APPLICATION

This application claims priority under 35 U.S.C. 119 to Korean Patent Application No. 10-2008-0130931, filed on Dec. 22, 2008, which is hereby incorporated by reference in its entirety.

BACKGROUND

1. Field of the Disclosure

This disclosure relates to an ink-jet print apparatus and method adapted to prevent stain defects.

2. Description of the Related Art

Recently, a variety of flat panel display devices with reduced weight and volume have been widely used instead of cathode ray tube (CRTs). The flat panel display devices include liquid crystal display (LCD) devices, field emission display (FED) devices, plasma display panels (PDPs), and light emitting diode (LED) display devices. These flat panel display devices are applied to image display appliances such as televisions and computer monitors, in order to display lettering and a variety of images including moving images. Among these flat display devices, LCD devices have been used in a variety of fields because they allow electronic appliances to be light weight and thin and have an improved mass productivity.

More particularly, the LCD device of an active matrix type has superior image-quality and low electric power consumption. In addition, the active matrix LCD device has been more rapidly developed to be large-sized and highly defined due to recently secured mass producing technology and obtained research results.

The LCD device is manufactured using a liquid crystal panel formation process which involves producing a thin film transistor substrate, producing a color filter substrate, injecting liquid crystal between the substrates, and sealing the substrates, followed by a process of attaching a polarization plate, a driver substrate, and a backlight unit to the liquid crystal panel. The thin film transistor substrate includes a thin film transistor and a pixel electrode which are formed in each pixel. The color filter substrate includes a common electrode facing the thin film transistor substrate, as well as red, green, and blue filters formed opposite each pixel.

FIG. 1 is a planar view showing a color pixel included in a LCD device according to the related art. FIG. 2 is a cross-sectional view showing the color pixel of the LCD device taken along the line A-A' shown in FIG. 1. As shown in FIG. 1, the LCD device includes a thin film transistor substrate 10, a color filter substrate 20, and liquid crystal (not shown) interposed between the substrates 10 and 20.

On the thin film transistor substrate 10, a plurality of gate lines 11 extending in a horizontal direction and a plurality of data lines 12 extending in a vertical direction are formed crossing each other. Each thin film transistor 13 is formed at each of the intersection of the gate and data lines 11 and 12. The thin film transistor substrate 10 includes a pixel electrode 14 formed on each pixel region which is defined by the crossing gate and data lines 11 and 12. The color filter substrate 20 includes a common electrode 24 opposite to all the pixel electrodes 14. Although it is not shown in the drawing, the color filter substrate 20 further includes color filters realizing a variety of colors.

The operation of LCD device with the above configuration can be explained as a change of the molecular alignment of the liquid crystal. More specifically, the thin film transistor 13 is turned on and allows a data voltage on the data line 12 to be applied to the pixel electrode 14 when a gate-on signal is applied to the gate line 11. At this time, a reference voltage (or a common voltage) is also applied to the common electrode 24. As such, the molecular alignment of the liquid crystal is changed by an electric field corresponding to a voltage difference between the data voltage on the pixel electrode 14 and the reference voltage on the common electrode 24.

As shown in FIG. 2, the thin film transistor substrate 10 includes two insulation films 15 and 16 formed on it. The insulation films are a gate insulation film 15 covering a gate line (not shown), and a passivation film 16 protecting a thin film transistor (not shown), respectively. The insulation films 15 and 16 are generally formed of silicon nitride. A data line 12, a semiconductor layer (not shown), and source/drain electrodes (not shown) are formed in the respective regions on the gate insulation film 15. Pixel electrodes 14 are formed on the passivation film 16.

On the other hand, the color filter substrate 20 includes a color filter layer 22 for realizing a variety of colors and a common electrode 24. The color filter layer 22 includes three different color filters arranged alternating with one another, even though a red color filter R and a green color filter G are shown in the drawing. The three different color filters consist of the three primary colors, respectively. A black matrix 21 is formed on a boundary region between the different color filters R and G adjacent to each other. The black matrix 21 blocks light penetrated through a liquid crystal on the boundary region which is not controlled by the pixel electrode 14. On the black matrix 21 and the color filter layer 22, an overcoat film 23 and the common electrode 24 are sequentially formed. The overcoat film 23 can be selectively used for applying superior step coverage to the formation of the common electrode 25, in spite of the topology of the color filter substrate 20 caused by the black matrix 21 and the color filter layer 22. In other words, it is not necessary to use the overcoat film 23. The common electrode 24 faces the pixel electrodes 14 on the thin film transistor substrate 10. A liquid crystal 30 is injected between the thin film transistor substrate 10 and the color filter substrate 20. The molecular alignment of the liquid crystal 30 changes direction according to a voltage which is applied between the common electrode 24 and the pixel electrode 14.

The related art LCD device as configured above has malfunctions on the color filter layer 22. Actually, the color filter layer 22 is formed by an ink-jet printing process of jet color filter materials into each sub-pixel. In this case, the topology (i.e., the surface state) of the color filter substrate causes a size difference between the color filters injected into the sub-pixels. Due to this, a stain defect is generated on an image displayed by the related art LCD device.

BRIEF SUMMARY

Accordingly, the present embodiments are directed to ink-jet print apparatus and method that substantially obviate one or more of problems due to the limitations and disadvantages of the related art.

An object of the present embodiment is to provide ink-jet print apparatus and method adapted to prevent stain defects.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an ink-jet print apparatus includes: first to third head portions configured to form red, green, and blue color filters on a substrate; a plurality of nozzles provided in each of the first to third head portions; a camera, above the substrate, configured to photograph a transmittance of each of sub-pixels in which the red, green, and blue are formed; a light emission unit, under the substrate opposite to the camera, configured to emit light on the sub-pixel; and an injection quantity control unit configured to compare the transmittance of each sub-pixel photographed by the camera with a previously prepared reference transmittance and to compensate the injection quantity of the nozzle.

An ink-jet print method according to another aspect of the present embodiment includes: forming red, green, and blue color filters in respective sub-pixel on a substrate as the substrate moves along an aligning direction of first to third head portions each including a plurality of nozzles; sequentially measuring the line by line transmittance of each sub-pixel on the substrate in which the red, green, and blue color filters are formed; identifying a poor sub-pixel through a comparison of the measured transmittance of the sub-pixel and a previously prepared reference of the sub-pixel; and adjusting an injection quantity of the nozzle opposite to the poor sub-pixel by a compensation setting value derived from the compared resultant.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
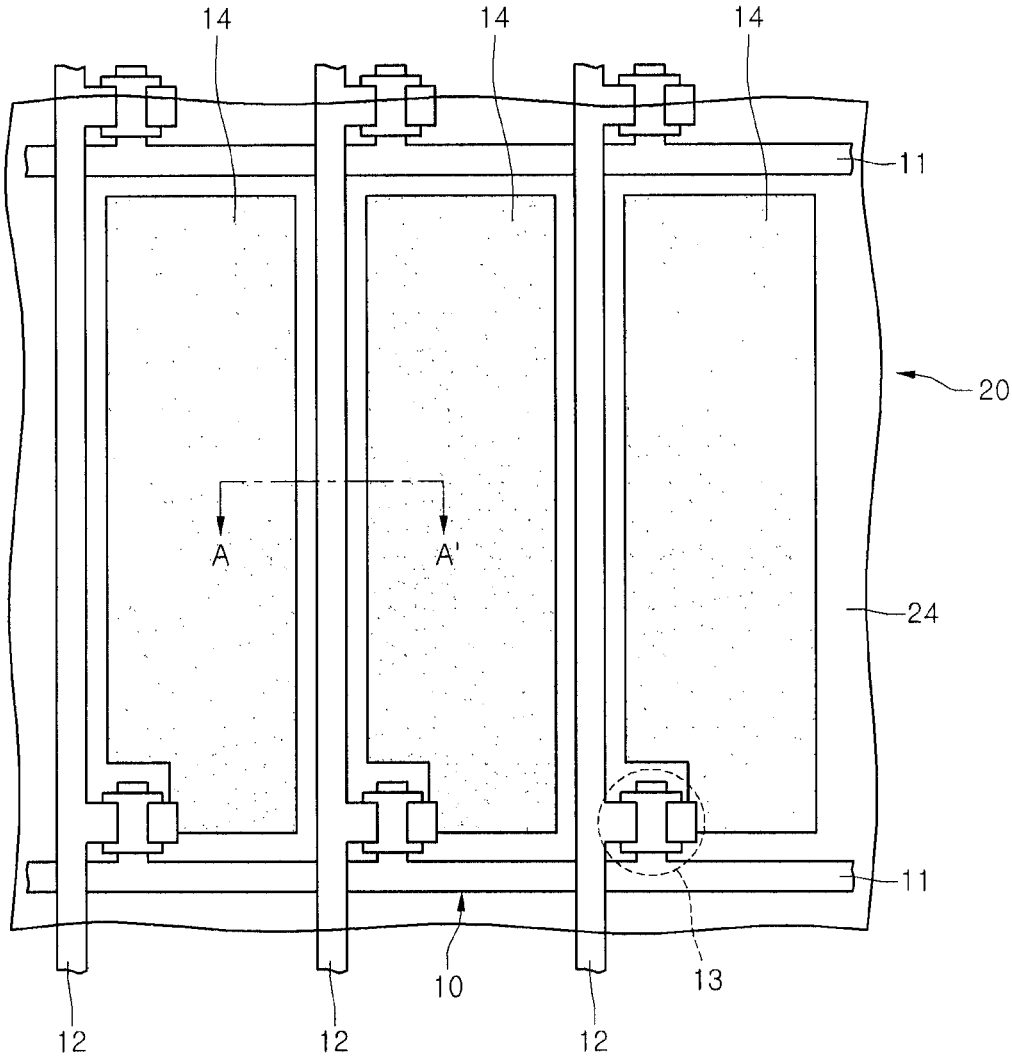
FIG. 1 (Related Art)
FIG. 1 is a plane view showing a color pixel included a LCD device according to the related art.
Figure 2:
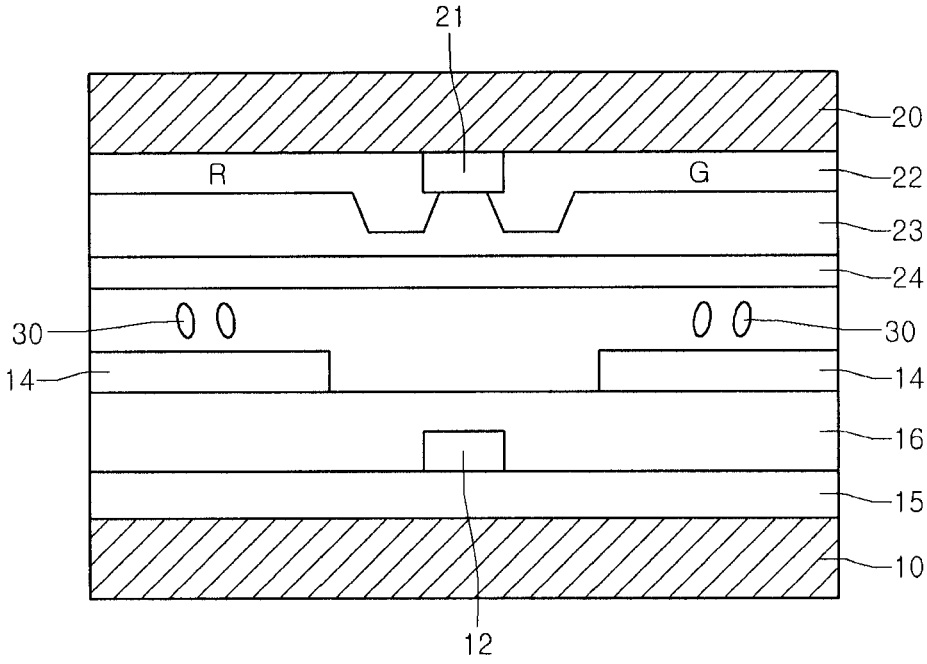
FIG. 2 (Related Art)
FIG. 2 is a cross-sectional view showing the color pixel of the LCD device taken along the line A-A' shown in FIG. 1.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 3:
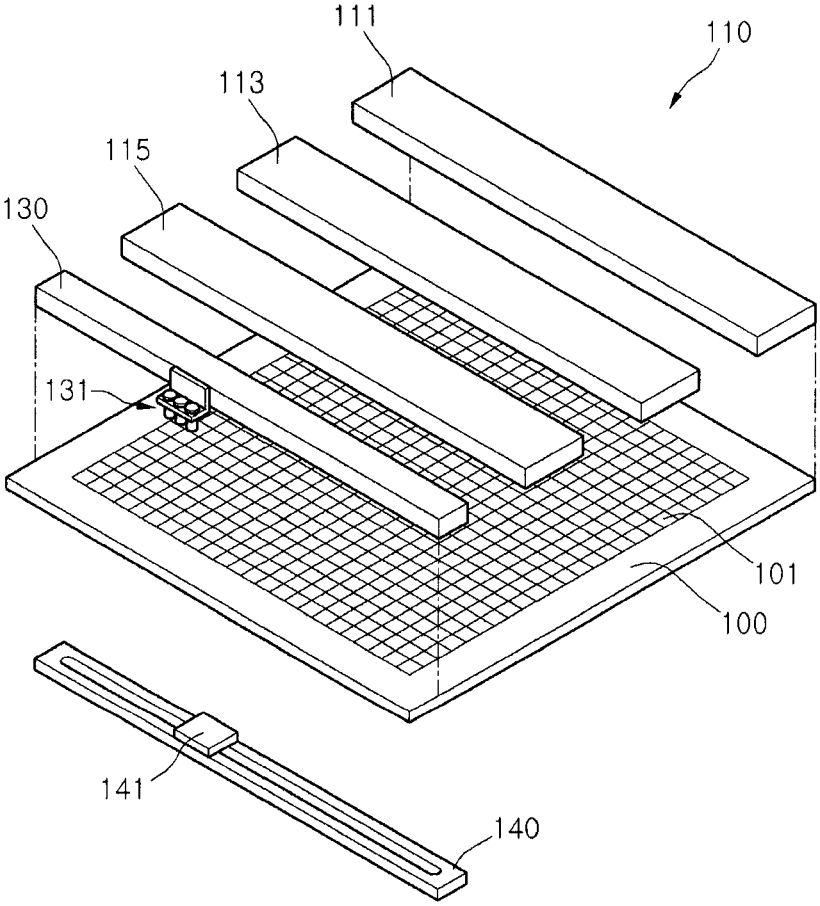
FIG. 3 is a schematic diagram showing an ink-jet print apparatus according to an embodiment of the present disclosure.
Figure 4:
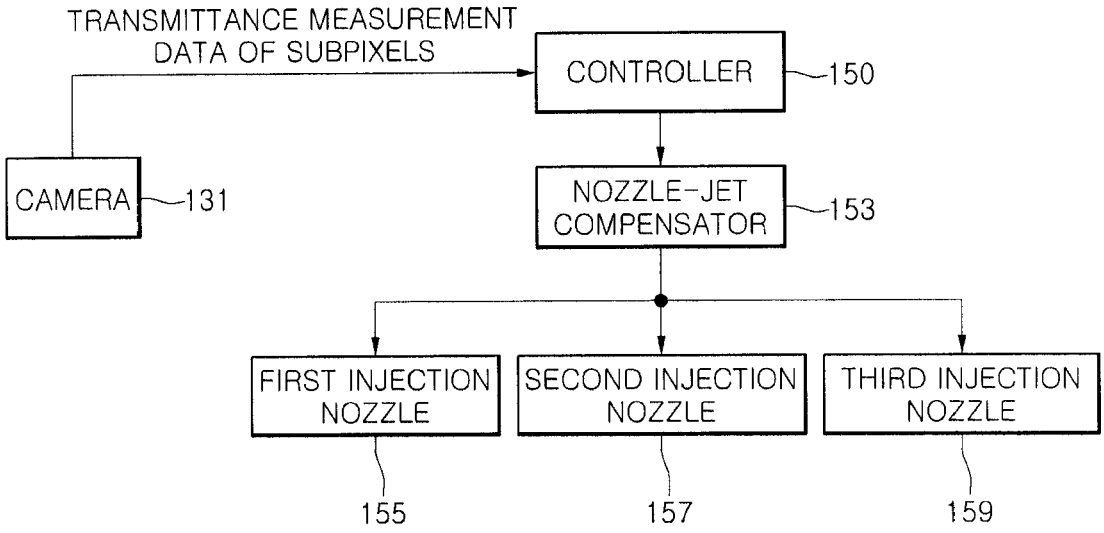
FIG. 4 is a block diagram showing a jet quantity control unit included in an ink-jet print apparatus according to an embodiment of the present disclosure.

FIG. 3 is a schematic diagram showing an ink-jet print apparatus according to an embodiment of the present disclosure. FIG. 4 is a block diagram showing an injection quantity control unit included in an ink-jet print apparatus according to an embodiment of the present disclosure. Referring to FIGS. 3 and 4, an ink-jet print apparatus 110 according to an embodiment of the present disclosure includes a first head portion 111 configured to form red color filters on a substrate 100, a second head portion 113 configured to form green color filters on the substrate 100, and a third head portion 115 configured to form blue color filters on the substrate 100.

Although it is not shown in the drawings, each of the first to third head portions 111, 113, and 115 includes a plurality of nozzles (not shown) and is connected to a respective material supplier (not shown). Each of the plural nozzles may scan a designated region on the substrate 100. The material suppliers are filled with red, green, and blue color filter materials, respectively. The ink-jet print apparatus 110 may be an apparatus configured to form red, green, and blue color filters on a color filter substrate which is included in an LCD device. As such, the first to third head portions 111, 113, and 115 inject the red, green, and blue color filter materials on the substrate 100 in a horizontal direction, thereby forming red, green, and blue color filters in sub-pixels on the substrate 100.

The ink-jet print apparatus 110 further includes a transmittance measuring unit for measuring the transmittances of the red, green, and blue color filters formed in the sub-pixels on the substrate 100. The transmittance measuring unit includes a camera 131 disposed above the substrate 100 and configured to photocopy each sub-pixel, a camera supporting bar 130 configured to support the camera 131, a light emission unit 141 disposed under the substrate 100 opposite to the camera 131, and a light emission unit supporting bar 140 configured to support the light emission unit 141.

The camera 131 includes a plurality of charge coupled devices (CCDs) so that the transmittances of the red, green, and blue color filters can be measured all at once. Although it is not shown in the drawings, the camera 131 includes a first feeder (not shown) configured to move the camera 131 along a longitude direction of the camera supporting bar 130. Similarly, the light emission unit 141 includes a second feeder (not shown) configured to move the light emission unit 141 along a longitude direction of the light emission supporting bar 140. As such, the camera 131 moves along the longitude direction of the camera supporting bar 130 and measures the transmittances of sub-pixels arranged in one horizontal line of the substrate 100. The light emission unit 141 also moves along the longitude direction of the light emission unit supporting bar 141 and sequentially emits light on the sub-pixels on one horizontal line of the substrate 100. In other words, the camera 131 may move in synchronization with the light emission unit 141 so as to be always opposite the light emission unit 141.

The ink-jet print apparatus with the transmittance measuring unit which includes the camera 131 and the light emission unit 141, as described above, sequentially measures line by line the transmittance of each of the sub-pixels on the substrate 100. Also, the ink-jet print apparatus adjusts the injection-quantity of each nozzle corresponding to a poor sub-pixel 101 which is identified on the basis of the transmittance measured using the camera 131 and the light emission unit 141. To this end, the ink-jet print apparatus further includes an injection-quantity control unit shown in FIG. 4.

The injection-quantity control unit of the ink-jet print apparatus includes a controller 150 receiving transmittance measurement data for each sub-pixel 101 photographed by the camera 131, a nozzle-jet compensator 153 adjusting the injection quantity of a nozzle opposite to a poor sub-pixel which is identified by the controller 150 on the basis of the transmittance data for each of the sub-pixels, and first to third injection-nozzles 155, 157, and 159 for red, green, and blue color filter materials.

The controller 150 compares the transmittance measure data of each sub-pixel 101, which is input from the camera 131, with a reference transmittance data and identifies poor sub-pixels having the transmittance measure data different from the reference transmittance data. Also, the controller 150 calculates compensation values for the poor sub-pixels.

The nozzle-jet compensator 153 adjusts the injection of color filter materials into the poor sub-pixels identified by the controller 150. More specifically, the nozzle-jet compensator 153 updates a compensation setting value designating the injection quantity, in each jet-nozzle 155, 157, and 159, in order to adjust the quantity of a color filter material which is injected into each poor sub-pixel.

The first to third jet-nozzles 155, 157, and 159 for the red, green, and blue color filter materials inject the quantity of respective color filter material corresponding to the compensation setting value updated by the nozzle-jet compensator 153, into the respective sub-pixel.

Such an injection quantity control unit of the ink-jet print apparatus 110 may be driven either prior to starting the formation process of the color filters on a substrate 100, or after at least one component (for example, the jet-nozzle, the head portion, and/or others) of the ink-jet print apparatus is replaced.

In this manner, the ink-jet print apparatus forming the color filters on the substrate 100 measures the transmittance of each sub-pixel 101, identifies the poor sub-pixel having a measured transmittance different from the previously prepared reference transmittance, and adjusts the injection quantity of the jet-nozzle injecting the color filter material into the poor sub-pixel. As such, the ink-jet print apparatus improves the reliability of the color filter substrate. The ink-jet print apparatus injects the color filters each having a desired transmittance into the sub-pixels, thereby preventing the previous generation of stain defects.

Figure 5:
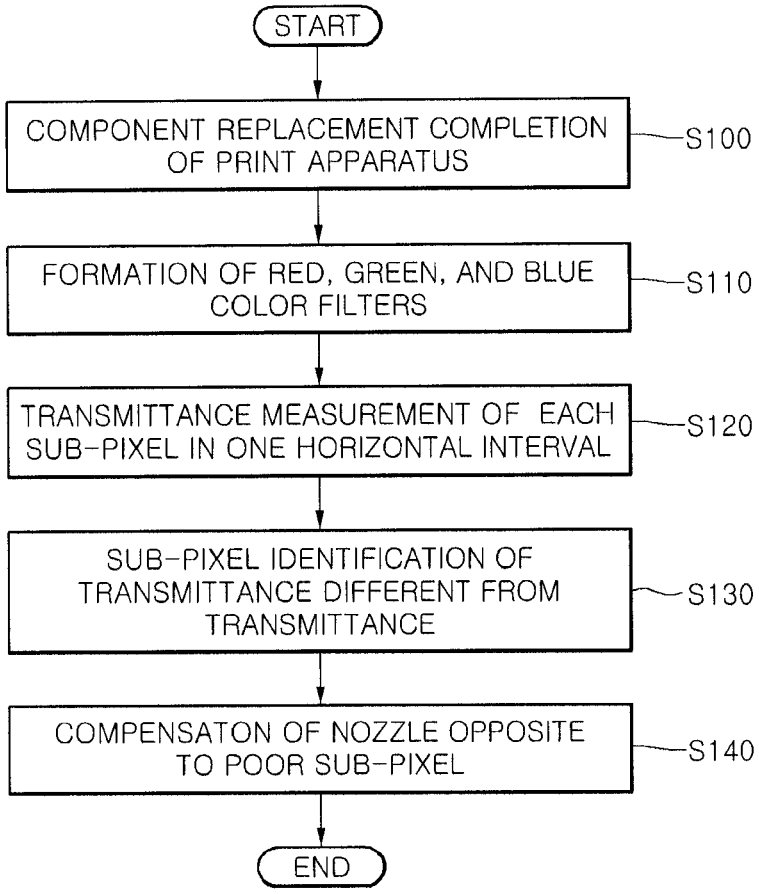
FIG. 5 is a flow chart explaining an ink-jet print method according to an embodiment of the present disclosure.

FIG. 5 is a flow chart explaining an ink-jet print method according to an embodiment of the present disclosure. As shown in FIG. 5, an ink-jet print method according to an embodiment of the present disclosure may be performed either prior to starting the formation process of the color filters on a substrate 100, or after at least one component (for example, the jet-nozzle, the head portion, and/or others) of the ink-jet print apparatus is replaced (step S100).

In step S110, the red, green, and blue color filters are formed in the respective sub-pixels on the substrate 100 as the substrate 100 moves along an aligning direction of the first to third head portions 111, 113, 115, which each include a plurality of jet-nozzles injection red, green, or blue color filter material.

The transmittance of each sub-pixel is sequentially measured line by line from the substrate 100 in which the color filters are formed (step S120). At this time, the transmittance of each sub-pixel is detected by the camera 131 and the light emission unit 141, and applied to the controller 150.

The controller 150 compares the measured transmittance of each sub-pixel with the previously prepared reference transmittance and identifies poor sub-pixels each having a measured transmittance different from the reference transmittance (step S130).

The transmittance of each poor sub-pixel is adjusted by calculating a compensation setting value opposite to each poor sub-pixel and controlling the injection quantity of the color filter material in correspondence with the compensation setting value (step S140).

As described above, the ink-jet print apparatus according to an embodiment of the present disclosure measures the transmittance of each sub-pixel 101, identifies the poor sub-pixel having the measured transmittance different from the previously prepared reference transmittance, and adjusts the injection quantity of the jet-nozzle injecting the color filter material into the poor sub-pixel. Therefore, the ink-jet print apparatus improves the reliability of the color filter substrate. As a result, the ink-jet print apparatus can prevent the previous generation of stain defects.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. An ink jet print apparatus, comprising:

first to third head portions configured to form red, green, and blue color filters on a substrate;

a plurality of nozzles provided in each of the first to third head portions;

a camera, above the substrate, configured to photograph a transmittance of each of sub-pixels in which the red, green, and blue are formed;

a light emission unit, under the substrate opposite to the camera, configured to emit light on the sub-pixel; and an injection quantity control unit configured to compare the transmittance of each sub-pixel photographed by the camera with a previously prepared reference transmittance and to compensate the injection quantity of the nozzle, wherein the camera includes a plurality of charge coupled devices such that the transmittance of the red, green, and blue color filters measured all at once, wherein the injection quantity control unit includes a controller configured to identify a poor sub-pixel based on the transmittance of each sub-pixel photographed by the camera and a nozzle jet compensator configured to adjust the quantity of a color filter material which is injected into each poor sub-pixel and the injection quantity of the respective nozzle according to a compensation setting value which is calculated on the basis of the transmittance of the poor sub-pixel by the controller, wherein the each of the plurality of nozzles has the compensation setting value updated by the nozzle jet compensator and the injection quantity designated by the compensation setting value, and wherein the controller receives transmittance measurement data for each sub-pixel photographed by the camera, wherein the controller compares the transmittance measurement data of each sub-pixel, which is input from the camera, with a reference transmittance data and identifies poor sub-pixels having the transmittance measure data different from the reference transmittance data, and wherein the controller calculates the compensation setting value for the poor sub-pixels by to compare the transmittance of each sub-pixel photographed by the camera with a previously prepared reference transmittance.

2. The inkjet print apparatus according to claim 1, wherein the camera is installed on a camera supporting bar disposed in a horizontal direction above the substrate and moves along a longitude direction of the camera supporting bar.

3. The inkjet print apparatus according to claim 1, wherein the light emission unit is installed in a light emission unit supporting bar disposed in a horizontal direction under the substrate and moves along a longitude direction of the light emission unit supporting bar.

4. The ink-jet print apparatus according to claim 1, wherein the camera sequentially photographs line by line the transmittances of the sub-pixels on the substrate.

5. An ink-jet print method, comprising:

forming red, green, and blue color filters in respective sub-pixel on a substrate as the substrate moves along an aligning direction of first to third head portions each including a plurality of nozzles;

sequentially measuring the line by line transmittance of each sub-pixel on the substrate in which the red, green, and blue color filters are formed;

identifying a poor sub-pixel through a comparison of the measured transmittance of the sub-pixel and a previously prepared reference of the sub-pixel;

calculating a compensation setting value for the poor sub-pixels by to compare the transmittance of each sub-pixel photographed by a camera with a previously prepared reference transmittance;

updating the compensation setting value calculated by a controller in each of the plurality of nozzles; and adjusting a quantity of a color filter material which is injected into each poor sub-pixel and an injection quantity of the each of the plurality of nozzles opposite to the poor sub-pixel by a compensation setting value derived from the compared resultant, wherein the measure of the transmittance of each sub-pixel is performed in a state that the camera and a light emission unit each disposed above and under the substrate move along a horizontal direction, wherein the camera includes a plurality of charge coupled devices such that the transmittance of the red, green, and blue color filters measured all at once, wherein the controller receives transmittance measurement data for each sub-pixel photographed by the camera, wherein the controller compares the transmittance measurement data of each sub-pixel, which is input from the camera, with a reference transmittance data and identifies poor sub-pixels having the transmittance measure data different from the reference transmittance data, and wherein the controller calculates the compensation setting value for the poor sub-pixels by to compare the transmittance of each sub-pixel photographed by the camera with a previously prepared reference transmittance.

* * * * *